US005330136A

United States Patent [19]

Colbaugh

[11] Patent Number: 5,330,136

[45] Date of Patent: Jul. 19, 1994

[54] RAILWAY CODED TRACK CIRCUIT APPARATUS AND METHOD UTILIZING FIBER OPTIC SENSING

[75] Inventor: Michael E. Colbaugh, Levelgreen, Pa.

[73] Assignee: Union Switch & Signal Inc., Pittsburgh, Pa.

[21] Appl. No.: 951,582

[22] Filed: Sep. 25, 1992

[51] Int. Cl.[5] ..... B61L 25/02; G01L 1/24

[52] U.S. Cl. ..... 246/122 R; 246/246; 250/227.16; 73/800; 385/13

[58] Field of Search ..... 250/227.14, 227.15, 250/227.16; 385/12, 13; 356/73.1, 373; 73/800; 246/122 R, 246, 247, 249, 34 R, 34 B, 34 CT

[56] References Cited

U.S. PATENT DOCUMENTS

| | | | |
|---|---|---|---|
| 4,200,856 | 4/1980 | Gilcher | 246/249 X |
| 4,362,057 | 12/1982 | Gottlieb et al. | 385/12 X |
| 4,498,650 | 2/1985 | Smith et al. | 246/122 R |
| 4,560,016 | 12/1985 | Ibanez et al. | 250/227.16 X |
| 4,619,425 | 10/1986 | Nagel | 246/34 R |
| 4,701,614 | 10/1987 | Jaeger et al. | 385/13 X |
| 4,701,866 | 10/1987 | Harrison et al. | 246/247 X |
| 5,026,141 | 6/1991 | Griffiths | 250/227.15 X |
| 5,145,131 | 9/1992 | Franke | 246/122 R |
| 5,240,643 | 8/1993 | Buckley et al. | 385/13 X |

FOREIGN PATENT DOCUMENTS

| | | | |
|---|---|---|---|
| 3307246 | 9/1984 | Fed. Rep. of Germany | 246/247 |
| 3537588 | 4/1987 | Fed. Rep. of Germany | 246/122 R |
| 3815152 | 11/1989 | Fed. Rep. of Germany | 246/246 |
| 3844663 | 6/1990 | Fed. Rep. of Germany | 246/246 |
| 8300744 | 3/1983 | PCT Int'l Appl. | 250/227.16 |

OTHER PUBLICATIONS

Vengsarkar, Greene, Fogg & Murphy, "Spatially Weighted, Grating-based, Two-mode, Elliptical-Core Optical, Fiber Vibration Sensors," *Optics Letters*, vol. 16, No. 21, pp. 1707-1709 (Nov. 1, 1991).

An accumulation of articles and papers collectively referred to as "Extrinsic Fabry-Perot Interferometric (EFPI) Optical Fiber Sensors for Material and Structural Analysis: Recent Developments and Applications," published by the Fiber & Electro-Optics Research Center at Virginia Tech University, dated Oct. 1991.

Vengsarkar, Greene & Murphy, "Photoinduced Refractive-index Changes in Two-Mode, Elliptical-core Fibers: Sensing Applications," *Optics Letters*, vol. 16, No. 19, pp. 1541-1543 (Oct. 1, 1991).

Boiarski & Nilsson, "New Fiber Sensors Take Power Plant's Temperature," *Photonics Spectra*, pp. 92-94 (Sep. 1991).

Claus, "Fiber Sensors as Nerves for 'Smart Materials'," *Phototonics Spectra*, p. 75 (Apr. 1991).

Jungbluth, "Optical Fibers Measure Strain and Temperature," *Laser Focus World*, p. 155 (Jan. 1991).

Murphy, Miller, Vengsarkar and Claus, "Elliptical-Core Two-Mode Optical-Fiber Sensor Implementation Methods," *Journal of Lightware Technology*, vol. 8, No. 11, pp. 1688-1696 (Nov. 1990).

Wohlstein, "Fiberoptics For Practical Sensing Applications (II)," *Lasers and Optronics*, pp. 63-65 (Mar. 1990).

Garwood, "Fiber-Optic Sensors: Working on the Railroad," *Sensors*, pp. 43-44 (Oct. 1989).

Wohlstein, "Using Fiberoptics For Practical Sensing," *Lasers and Optronics*, pp. 73-76 (Jul. 1989).

Shadaram, "Sensing with Fibers," *Photonics Spectra*, pp. 117-118 (Jun. 1989).

*Primary Examiner*—Michael S. Huppert

*Assistant Examiner*—Scott L. Lowe

*Attorney, Agent, or Firm*—Buchanan Ingersoll

[57] ABSTRACT

A railway track circuit system utilizing an optical sensor which emits a vehicle detection light signal when a railway vehicle is present in a track section. A reference light signal is also generated by a light emission source. A detector in optical communication with the optical sensor receives the vehicle detection light signal. Information contained in the vehicle detection light signal is interpreted by a processor to detect the railway vehicle. In presently preferred embodiments, the sensor may comprise an elongated optical fiber conductor extending along the track section or a plurality of cascaded localized sensors. The sensor may generally also be utilized as a communication medium to pass communication data between opposite ends of the track section. Depending on the exigencies of the particular application, the sensor may be located within the track section in a number of ways.

52 Claims, 8 Drawing Sheets

RAILWAY CODED TRACK CIRCUIT APPARATUS AND METHOD UTILIZING FIBER OPTIC SENSING

BACKGROUND OF THE INVENTION

1. Field of the Invention.

The invention relates generally to the art of railway signalling and communication. More particularly, the invention relates to an apparatus and method utilizing fiber optic sensing to detect the presence of a railway vehicle within a track section as well as other conditions and parameters.

2. Description of the Prior Art.

Typical wayside instrumentation systems for railway and transit installations interconnect the central office to wayside equipment such as switch and signal devices so that traffic flow may be remotely directed. To prevent the establishment of conflicting routes, such instrumentation systems incorporate logical operation to disallow improper commands from the central office or other wayside equipment. This requires that the system have the capability of detecting the presence of railway vehicles within the controlled territory.

This train detection capability is typically provided by the railway track circuit. Generally, railway track circuits detect the presence of a railway vehicle by electrical alteration of a circuit formed by the rails and the vehicle wheel and axle sets. While there are many variations, such track circuits are typically connected within fixed-location, fixed-length sections of a track route known as blocks. Blocks may range in length from hundreds of feet to a maximum of approximately two to five miles.

To minimize the installation and maintenance of wayside communication, some railway track circuits have been employed which send control data between wayside locations using unoccupied blocks as a transmission medium. These track circuits are referred to as "coded track circuits." Once a vehicle enters a block having a coded track circuit, the communication link to the next wayside location is severed, but that unit then positively detects the presence of the vehicle. The track circuit codes, as well as the break in continual communication, are important input data to all wayside locations for control operations.

Alternative train operation systems have recently been proposed which require more accurate train detection than may be provided by present track circuits. One such system is the Advanced Train Control System ("ATCS") of the Association of American Railroads. For ATCS, and other proposed "moving block" or minimal headway systems, location resolution on the order of one meter may be important for effective control. Current railway systems could also benefit from this degree of resolution to permit vehicles to operate closer together and with a higher level of accuracy.

Additionally, track circuits employed in mainline areas also generally lack the capability to determine direction of motion, count axles or cars, communicate at rates higher than 100 bits per second, or determine the presence and location of fire in a tunnel.

SUMMARY OF THE INVENTION

A railway track circuit system practicing the invention includes a light emission source generating a reference light signal. An optical sensor emits a vehicle detection light signal when a railway vehicle is present in the track section. A detector in communication with the optical sensor receives the vehicle detection light signal. A processor operatively connected to the detector interprets the vehicle detection light signal to detect presence of the railway vehicle.

In presently preferred embodiments, the optical sensor allows optical conduction of at least a portion of the reference light signal such that the vehicle detection light signal results therefrom. In this case, the optical sensor is placed at the track section to experience an alteration in its light propagation characteristics, such as by physical deformation. In these presently preferred embodiments, the optical sensor is contemplated to comprise either an elongated optical fiber conductor extending along the track section or a plurality of cascaded localized sensors. The sensor may also generally be utilized as a medium to pass communication data between opposite ends of the track section. Since the sensor may be attached to the track section in a number of ways, flexibility is enhanced. Supplemental sensors may also be provided to monitor additional conditions and parameters within the track section.

DETAILED DESCRIPTION

Detailed Description of the Prior Art

Figure 1:
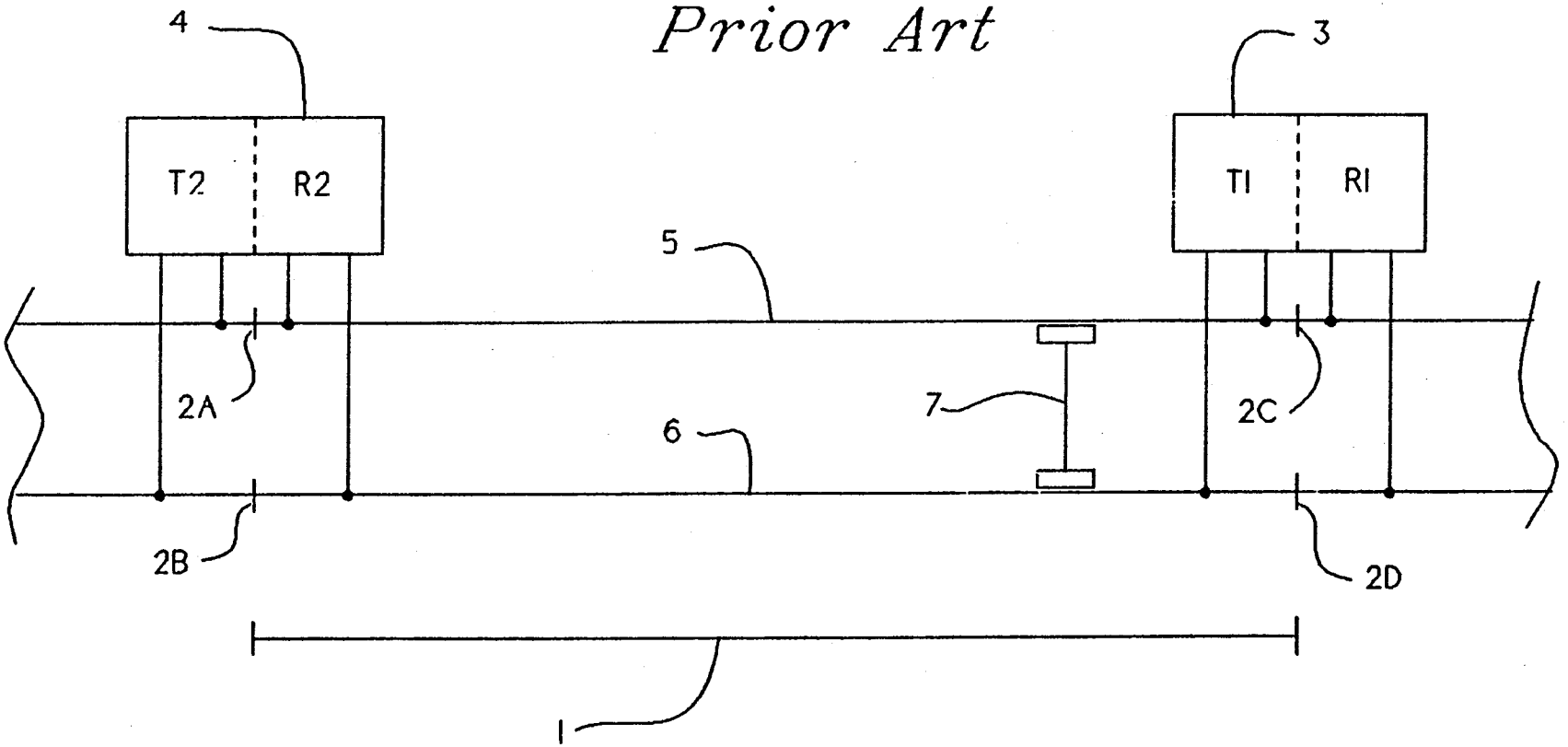
Fig.1. Prior Art
FIG. 1 is a diagrammatic representation of a prior art coded track circuit.

FIG. 1 illustrates a prior art coded track circuit installed within a block 1. Typically, block 1 is electrically isolated from adjacent blocks such as by a number of insulated rail joints 2A–D. A communication link between block 1 and adjacent blocks is provided by track circuit units 3 and 4, each of which has a transmitter and a receiver. Transmitter T1 of track circuit unit 3 is connected across rails 5 and 6 at a transmit end of block 1. Receiver R2 of track circuit unit 4 is connected across rails 5 and 6 at the receive end of block 1. Similarly, receiver R1 of track circuit unit 3 is connected across rails 5 and 6 at a receive end of the block immediately to the right of block 1. Transmitter T2 of track circuit unit 4 is connected across rails 5 and 6 at the transmit end of the block immediately to the left of block 1.

The coded track circuit within block 1 thus includes, in series, transmitter T1, rail 5, receiver R2 and rail 6. When block 1 is unoccupied by a railway vehicle and no state of broken rail exists, electrical current is free to circulate through this serial combination. This circulated electrical current is typically coded to carry signal information which may be used to indicate block 1 as being unoccupied and provide other control functions. Location resolution of such prior art coded track circuits is thus generally defined by the length of the block. That is to say, while these systems can positively detect the presence of a railway vehicle within a block, it cannot be particularly located therein.

Detailed Description of Presently Preferred Embodiments

In accordance with the invention, an apparatus and method of forming a coded track circuit may be provided which utilizes optical sensing principles as opposed to electrical conduction through the rails. The invention offers the capability of providing orders of magnitude higher communication rate, increased track circuit length with superior location resolution, more intrinsic noise and lightening resilience, and the additional capabilities of detecting: motion, direction, axle/car count, distributed fire detection as well as other conditions and parameters. As the teachings of the invention are applicable to many types of guideway transportation systems, such systems are to be included within the construction and scope of the terminology herein.

Figure 2:
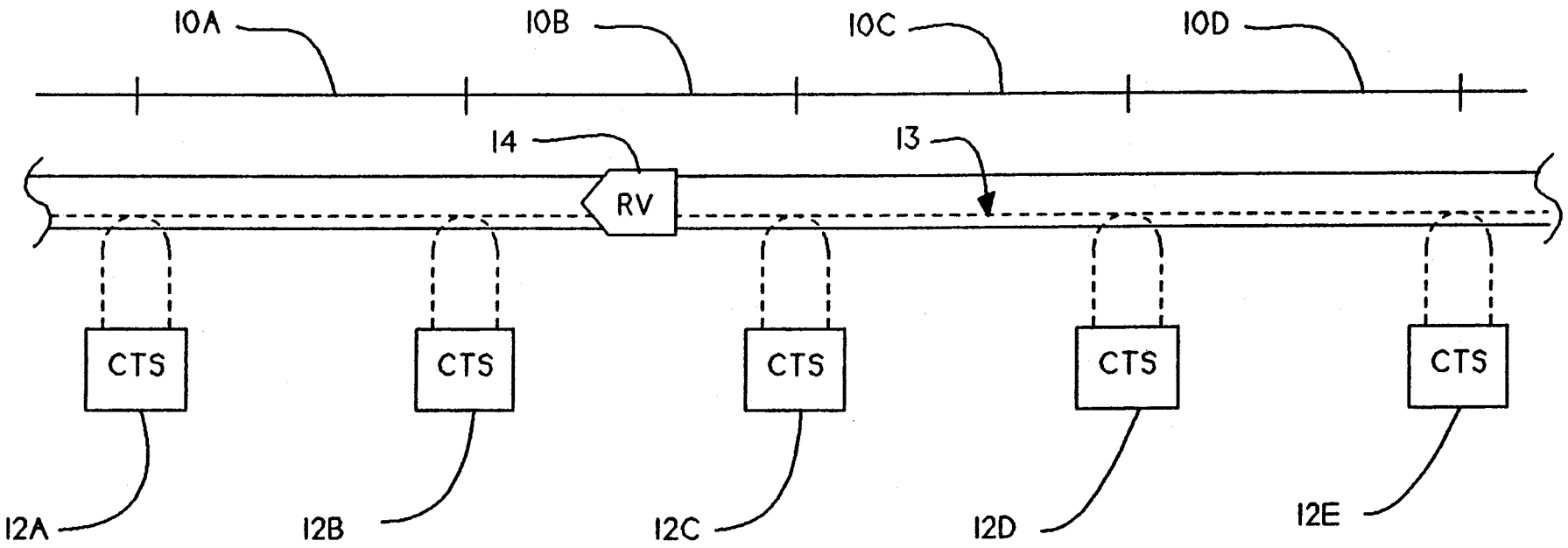
FIG. 2 is a diagrammatic representation of a railway vehicle moving along a track route having a plurality of coded track circuits constructed in accordance with the present invention.

FIG. 2 illustrates a plurality of coded track circuits constructed in accordance with the invention and installed along a portion of a track route. For purposes of illustration, the respective track circuits are shown as being confined within blocks 10A–D which generally coincide with the positioning of wayside coded track equipment sets ("CTS") 12A–E. The typical practical distance between respective of sets 12A–E may be ten kilometers or greater. It is to be understood that the invention allows the elimination of insulated rail joints, thus permitting use in moving block and other minimal headway systems.

In optical communication with sets 12A–E is optical sensor 13 which responds to the presence of railway vehicle 14 by emitting a vehicle detection signal which may be a reflection or change in intensity or other properties of a reference light signal or may be a generated light signal. Depending on the exigencies of a particular installation, presently preferred embodiments of sensor 13 may generally comprise either an elongated optical fiber conductor or a plurality of cascaded localized sensors. Within these general types, a number of further embodiments are contemplated, as will be explained more fully herein. Generally, sensor 13 is capable of determining location of vehicle 14 within the track section to resolutions on the order of one meter. Additionally, many embodiments of sensor 13 may further function as a communication link for passing coded information along blocks 10A–D. In contrast to the slower communication rates of prior art coded track circuits, a data rate of greater than 100,000 bits per second can thus be attained.

Figure 3A:
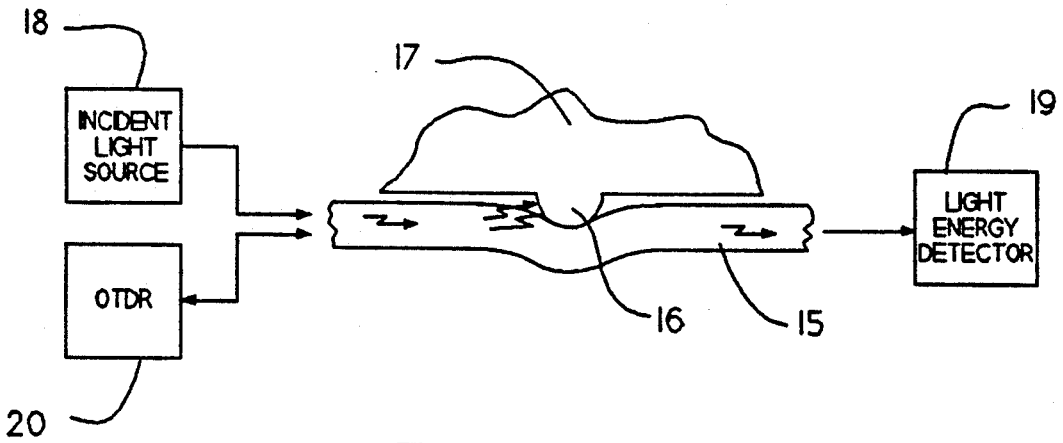
FIG. 3A is a diagrammatic representation of microbending phenomena utilized according to the teachings of the present invention.

Many details of attaching sensor 13 to the track section will depend on the particular technique used to analyze the variable light propagation characteristics. Fiber optic sensing techniques in which forcible engagement of an optical fiber can be detected have been discussed generally in such reference works as: (1) Brian Culshaw & John Dakin, eds., *Optical Fiber Sensors,* Vols. I and II, U.S.A.: Artech House Publishing (1988–89); and (2) Richard O. Claus, ed., *Proceedings of the Conference on OPTICAL FIBER-BASED SMART MATERIALS AND STRUCTURES* (*April* 1991 *Conference*), U.S.A.: Technomics Publishing (1991). The following techniques, however, wherein the forcible engagement causes physical deformation, are thought to be particularly useful in this application:

I. MICROBENDING—A phenomenon related to the change of light propagation characteristics of optical fiber caused by bending around a small radius typically on the order of the fiber's cross-section. FIG. 3A illustrates such an optical fiber 15 bent around a small semi-circular projection 16 on engaging structure 17. In this situation, reference light signals impressed onto fiber 15 by incident light source 18 will no longer experience the near total internal reflection characteristics of a straight fiber segment. Thus, some light energy will be "sunk" away from the core of fiber 15. The change in the propagated light signal may be measured at light energy detector 19. The resulting measurement is proportional to the severity of bending.

Microbending also causes some light energy to be reflected counter to the original direction of propagation. Optical time domain reflectometer ("OTDR") 20 may be utilized to measure this reflective light and map the variation of microbending strain experienced over a distributed length of fiber. Specifically, OTDR 20 impresses a pulsed light signal or edge onto fiber 15 and correlates the return time-of-flight of reflected energy to generate a time/distance plot of the reflected pulse image. OTDR 20 is also particularly useful in monitoring structural integrity of fiber 15. This can be used to provide a coded track circuit constructed according to the invention with the capability of detecting broken rail locations within centimeters.

Figure 3B:
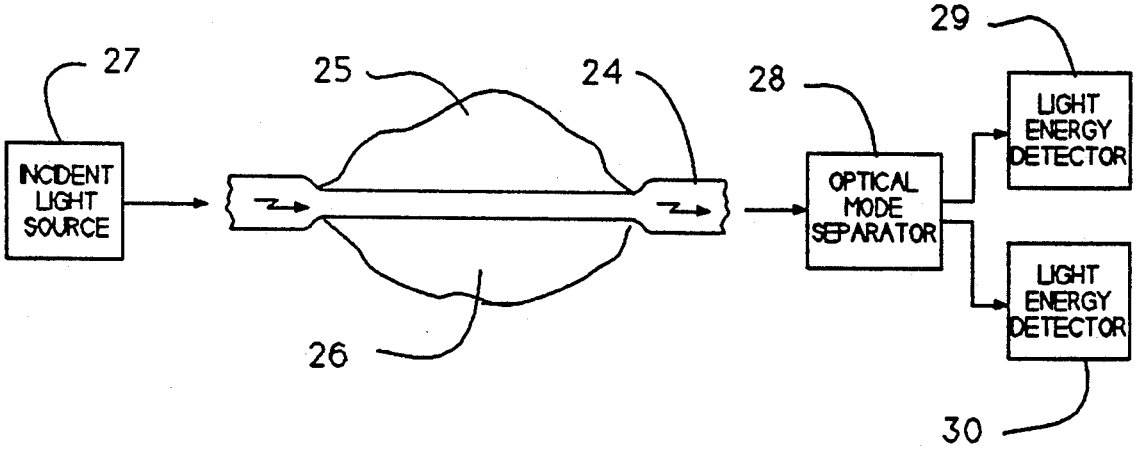
FIG. 3B is a diagrammatic representation of few-mode fiber sensing phenomena utilized according to the teachings of the present invention.

II. FEW-MODE FIBER SENSING—Squeezing stress applied to optical fiber constructed to propagate only a few modes of light will cause relative light intensity to be exchanged between the modes. A two-mode optical fiber 24 is illustrated in FIG. 3B under squeezing stress applied by engaging structures 25 and 26. The respective modes in the propagated light energy from incident light source 27 are optically separated at optical mode separator 28. The relative intensities of each mode are then measured at respective light energy detectors 29 and 30. The exchange of intensity is proportional to the amount of applied stress. This sensing technique yields very accurate results utilizing relatively simple sensing optics. It is also capable of detecting and distinguishing the combinational affects of temperature and pressure. Additionally, the engaging surfaces of structures 25 and 26 may simply be smooth.

Figure 3C:
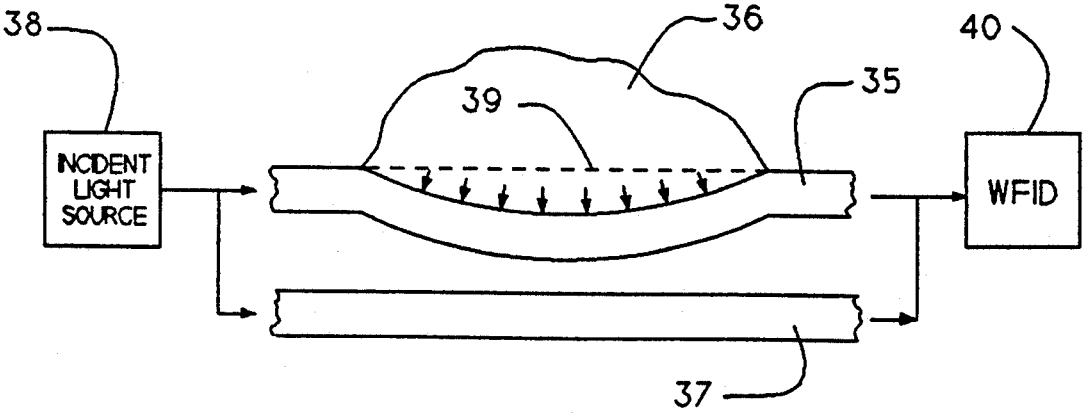
FIG. 3C is a diagrammatic representation of Fabry-Perot Interferometric techniques utilized according to the teachings of the present invention.

III. FABRY-PEROT INTERFEROMETRIC—Referring to FIG. 3C, a first optical fiber 35 is firmly attached to strain sensitive engaging structure 36. Additionally, a second optical fiber 37 is provided extending generally parallel to fiber 35 but isolated from strain forces imposed on engaging structure 36. Incident light source 38 impresses reference light signals on both of fibers 35 and 37. Strain effects imposed on engaging structure 36 due to bending, warping or vibration cause fiber 35 to become slightly longer than the at-rest position indicated by broken line 39. As a result, the phase of propagated light signals emanated by fiber 35 will be slightly shifted with respect to corresponding signals emanating from fiber 37. The resulting constructive or destructive interference effects can be measured at wave front interferometric detector ("WFID") 40 to determine the degree of strain imposed on engaging structure 36. In addition to detecting the presence of a railway vehicle, warped rail or the like may be detected by the occurrence of vibration above a threshold level.

Additionally, a technique known as black body radiation temperature sensing may be utilized to detect fires along the track route. Specifically, high temperature heating of an optical fiber (typically above 100° Celsius) can be detected as infrared radiation at the end of the fiber. By selectively detecting more than one wavelength and the relative intensities at each end, the temperature of an unusual "hot spot" can be measured and the relative location can be estimated.

Figure 4:
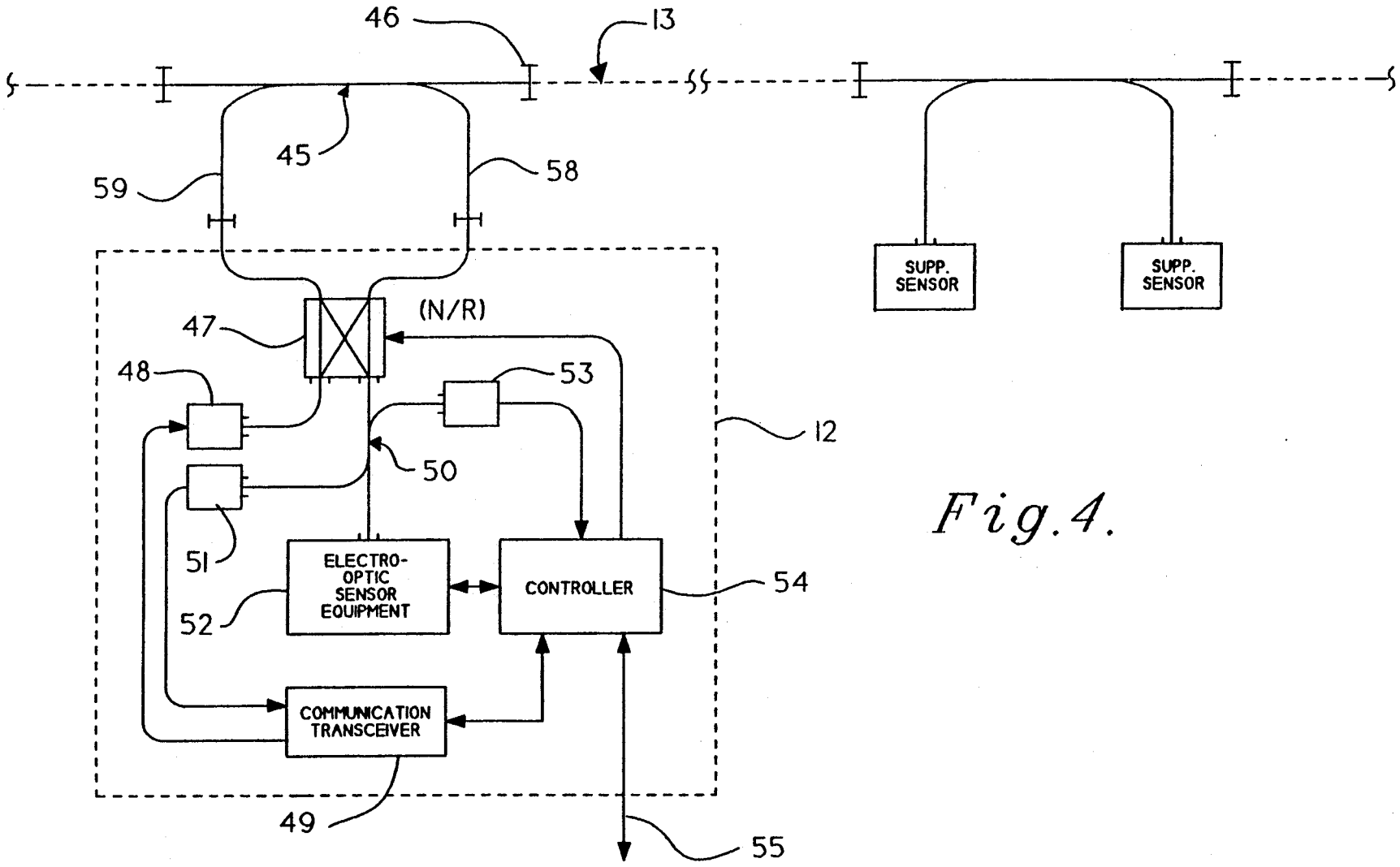
FIG. 4 is a schematic diagram of a coded track set and a pair of supplemental sensors constructed and utilized in accordance with the invention.

The instrumentation within a typical coded track equipment set 12 is diagrammatically illustrated in FIG. 4. Set 12 is optically connected to sensor 13 utilizing a fiber optic splitter 45 and fiber optic connectors, such as connector 46. An optical switch 47 is selectively operable in a normal or reverse position to dictate the direction of transmission and reception of optical signals. An electro-optic transmitter 48 receives electrical communication signals from communication transceiver 49 and responsively emits light communication signals. An internal fiber optic splitter 50 directs optical energy from switch 47 to electro-optic communication detector 51 and electro-optic sensor equipment 52. Electro-optic detector 53 is also connected to splitter 50 to detect a reference light signal which may be impressed thereon by equipment 52. A microprocessor based controller 54, which is in communication with other wayside equipment via line 55, functionally controls other equipment within set 12 as well as processing and responding to information provided by transceiver 49 and equipment 52.

As an example, consider coded light energy which may contain both communication signals and vehicle detection signals entering splitter 45 to the left of set 12. As used herein, the term "light" refers generally to photonic energy whether or not such energy is within the visible spectrum. At any rate, a portion of this energy will exit splitter 45 to the right of set 12 and continue to sensor 13. Some light energy, however, will be carried by right branch 58 into switch 47. This light energy will then be received through splitter 50 by detector 51 and equipment 52. With switch 47 in this same position, light signals produced by transmitter 48 travel through left branch 59 of splitter 45 and enter sensor 13 to the right of set 12. With switch 47 in its alternative reverse position, light energy will be received by and transmitted from set 12 in directions opposite to that described.

Figure 5:
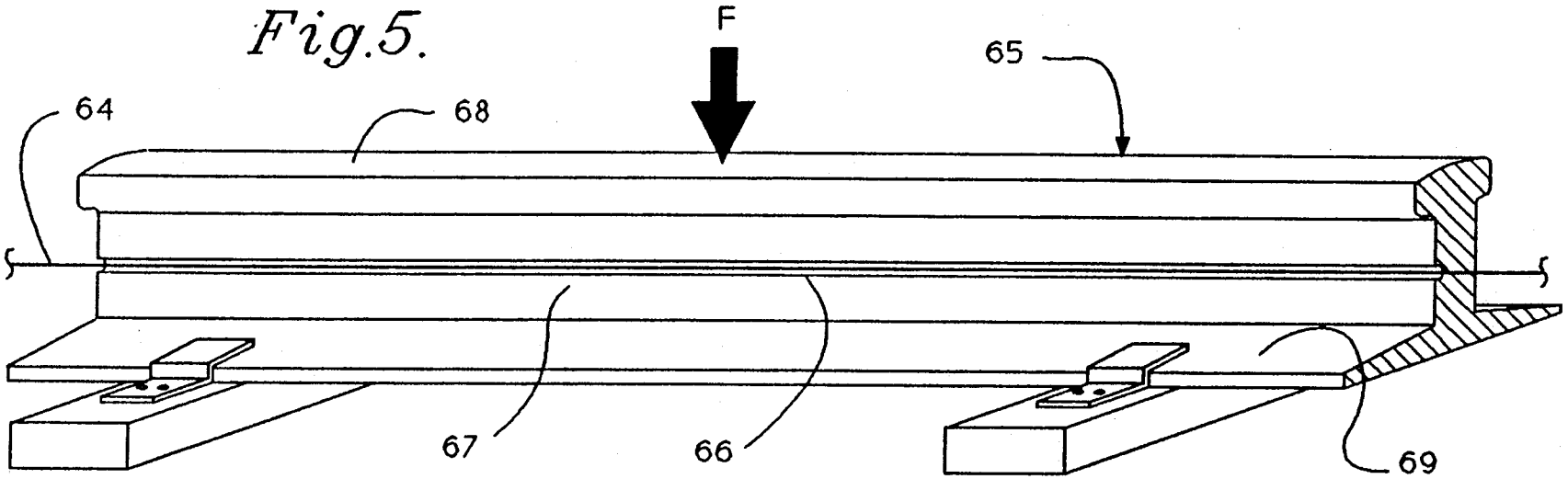
FIG. 5 is a fragmentary perspective view illustrating a rail of a track section having defined therein a longitudinal groove into which an elongated optical fiber conductor is placed.
Figure 6:
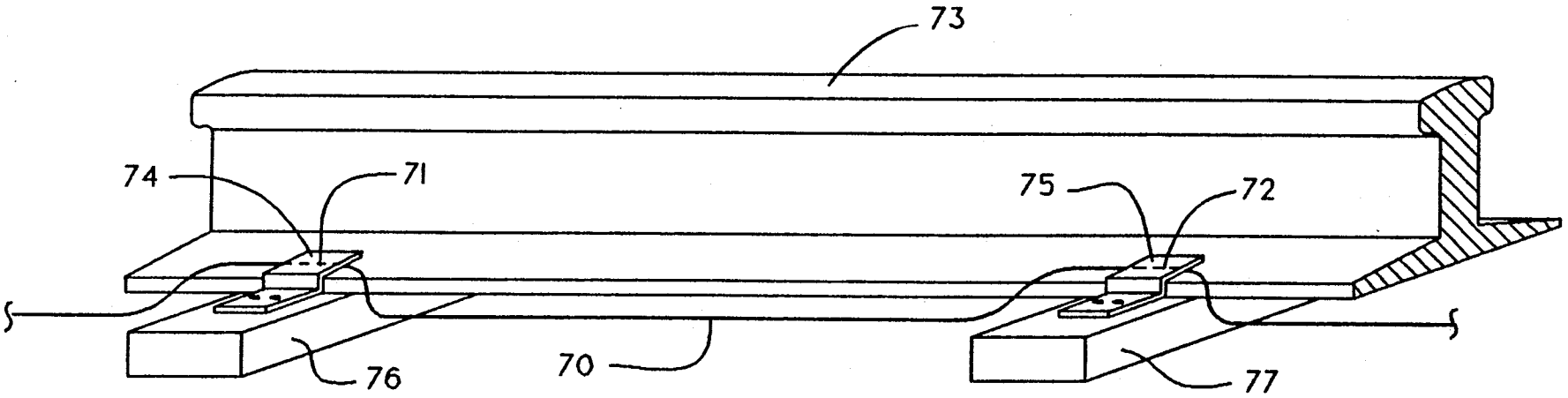
FIG. 6 is a fragmentary perspective view illustrating attachment of an elongated optical fiber conductor at spaced apart discrete locations by placement between a rail and rail-retaining tie plates of a track section.
Figure 7:
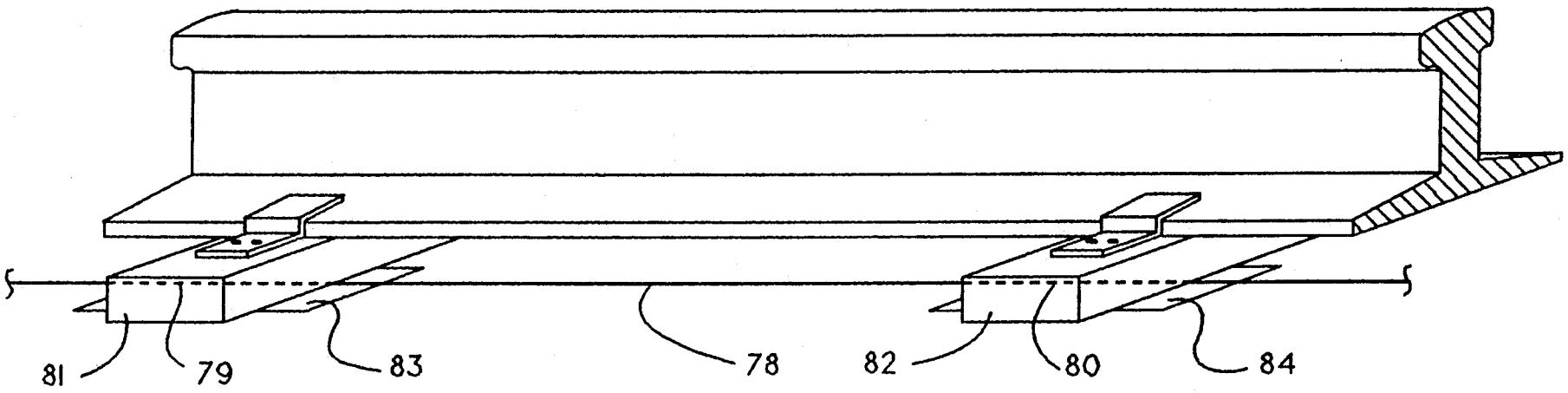
FIG. 7 is a fragmentary perspective view illustrating attachment of an elongated optical fiber conductor to a track section at spaced apart discrete locations by placement between track crossties and optional foundation plates.
Figure 8:
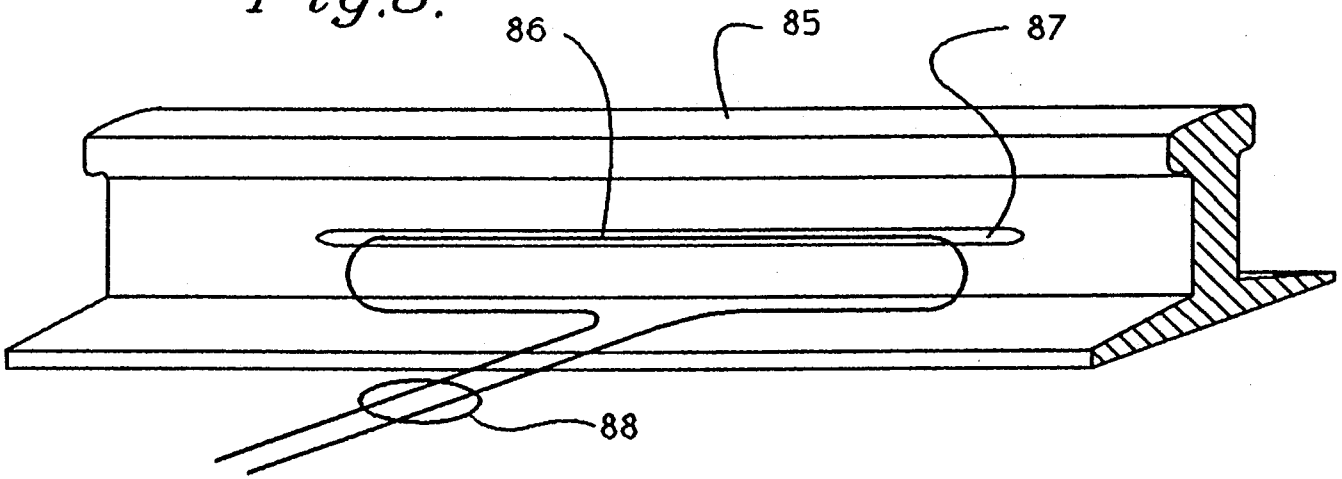
FIG. 8 is a fragmentary perspective view of a localized sensor having a section of sensitized optical fiber placed within an abbreviated longitudinal groove defined in a rail of a track section.

FIGS. 5 through 7 illustrate embodiments of sensor 13 comprising an elongated optical fiber conductor extending along the track route. Such "widely distributed" sensors may easily function also as a communication medium for the transmission of control data. Referring particularly to FIG. 5, a sensitized elongated optical fiber conductor 64 is attached to rail 65 by placement within longitudinal groove 66. Longitudinal groove 66 may be cut or pressed into rail 65 and may incorporate microbending or other application specific structural details. While shown in the web section 67 of rail 65, groove 66 may also be located in the head section 68 or base section 69 depending on desired sensitivity parameters or economics. Furthermore, while a notch or groove on the outside of the rail is illustrated, other embodiments practicing the invention could use specific geometric structures in the rail itself. A railway vehicle passing over rail 65 causes a downward force "F" to exert strain on the sides of groove 66. Depending on the sensing technique utilized, other parameters such as distributed temperature, vibration, structural integrity and train motion can be detected. With some techniques, more than one of these parameters can be determined utilizing a single embedded optical fiber.

FIG. 6 and 7 illustrate elongated optical fiber conductors attached to the track section at a plurality of spaced apart discrete locations. Standard wayside structures such as rail-retaining tie plates and rail crossties carry portions of a passing vehicle's weight load which can be sensed utilizing the teachings herein. FIG. 6 illustrates an elongated optical fiber conductor 70 having sensitized sections 71 and 72 respectively placed between rail 73 and rail-retaining tie plates 74 and 75. Alternatively, sensitized sections 71 and 72 could be respectively placed between tie plates 74 and 75 and rail crossties 76 and 77.

FIG. 7 illustrates an elongated optical fiber conductor 78 having sensitized sections 79 and 80 respectively placed under rail crossties 81 and 82. Foundation plates 83 and 84 may optionally be placed under sensitized sections 79 and 80 to provide a firm supporting understructure. It should be noted that sensor measurements taken from this type of arrangement are positionally discontinuous, but overall accuracy is affected very little due to the relative proximity of the attachment structures.

In addition to widely distributed sensors, the invention provides localized sensor arrangements which may be cascaded to detect a railway vehicle in longer track sections or function individually in shorter track sections. These localized sensors may also serve as supplemental sensors to monitor other parameters and conditions. Such localized sensors may terminate at the sensor site and may not carry communication signals from one location to another. In this case, a supplemental interequipment linking communication optical fiber conductor may be separately installed along the track route to add communication capability.

Figure 9:
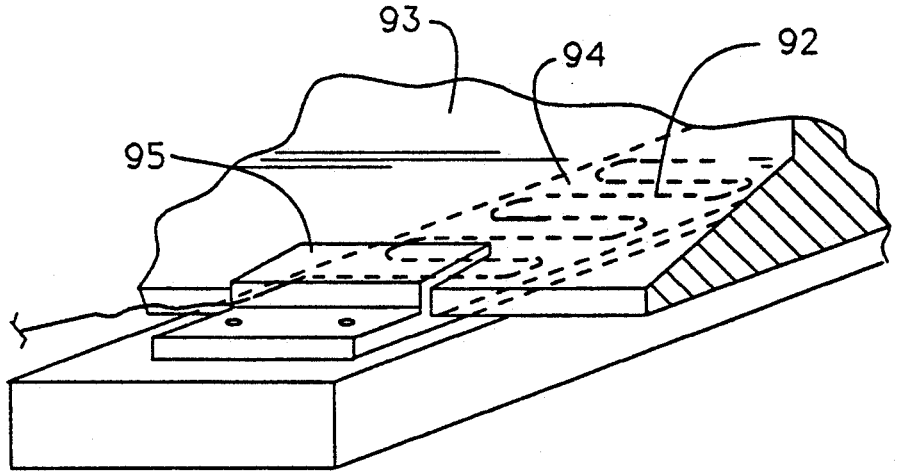
FIG. 9 is a magnified fragmentary view illustrating a localized sensor having a section of sensitized optical fiber placed between a rail and a rail-retaining tie plate.
Figure 10:
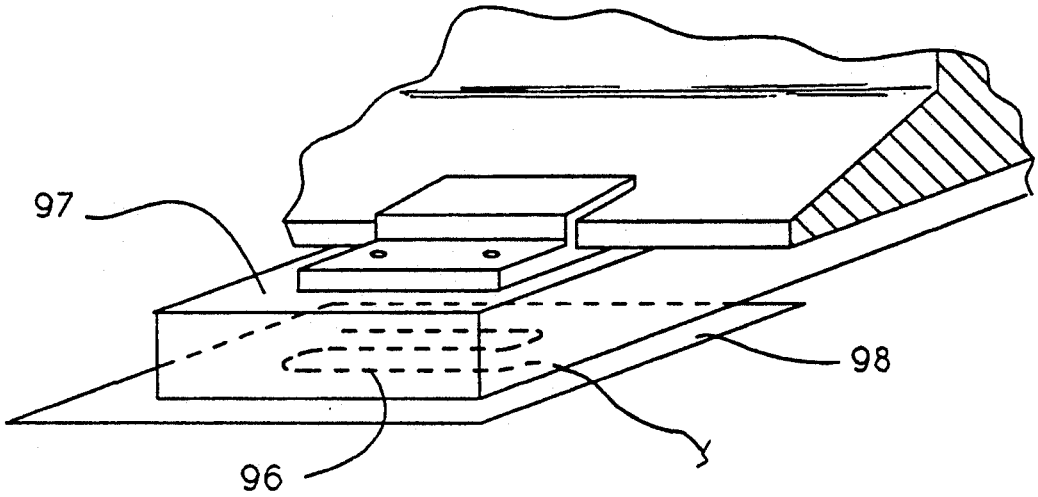
FIG. 10 is a magnified fragmentary view illustrating a localized sensor having a section of sensitized optical fiber placed between a track crosstie and an optional foundation plate.

FIGS. 8 through 11 illustrate localized sensors useful in axle or car counting, car weighing, or flat wheel detection applications. Referring particularly FIG. 8, a localized sensor arrangement is shown similar to that in FIG. 5 but installed on a very limited length of rail 85. This arrangement, although localized, can be an integral part of a continuous communication link from one location to another. Specifically, a sensitized section 86 of optical fiber is placed in an abbreviated longitudinal groove 87 in the web portion of rail 85. FIG. 9 illustrates an embodiment in which a sensitized section 92 of optical fiber conductor is placed between the base of rail 93 and an upper face 94 of rail-retaining tie plate 95. A further embodiment is shown in FIG. 10 in which a sensitized section 96 of optical fiber conductor is placed between crosstie 97 and a foundation plate 98.

Figure 11:
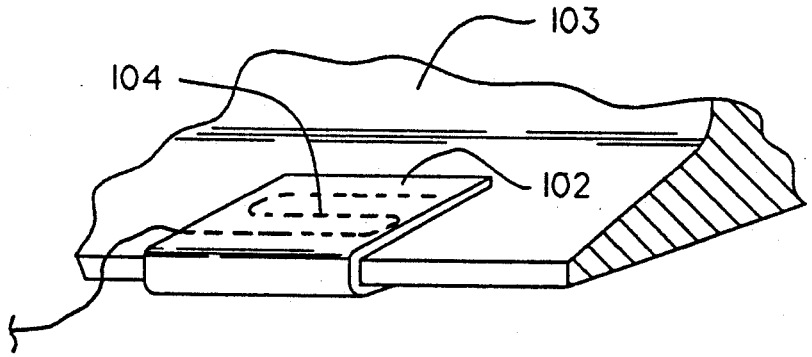
FIG. 11 is a perspective view illustrating a localized sensor having a strain responsive body attached to a rail and a section of sensitized optical fiber in compliant contact therewith.

FIG. 11 illustrates a localized sensor arrangement utilizing a strain responsive body 102 attached to rail 103. A sensitized optical fiber section 104 is mounted in compliant contact with body 102 such that strain effects imposed on rail 103 will alter the sensor light propagation characteristics. Body 102 may include internal strain inducing members, or may simply provide an independent structure against which a loaded rail may press as it is strained.

In addition to the specific embodiments of sensor 13 illustrated, other variations may also be provided within the teachings of the invention. For example, it may be desirable to have light signals input at one or more locations along the track section into an interequipment linking sensing or communication optical fiber conductor to provide vehicle presence or other control data. Additionally, since a large amount of rail is currently installed in the field, mechanical devices attached to or adjacent these rails such that vehicle forces may be transferred to optical fiber conductors are also contemplated.

Figure 12:
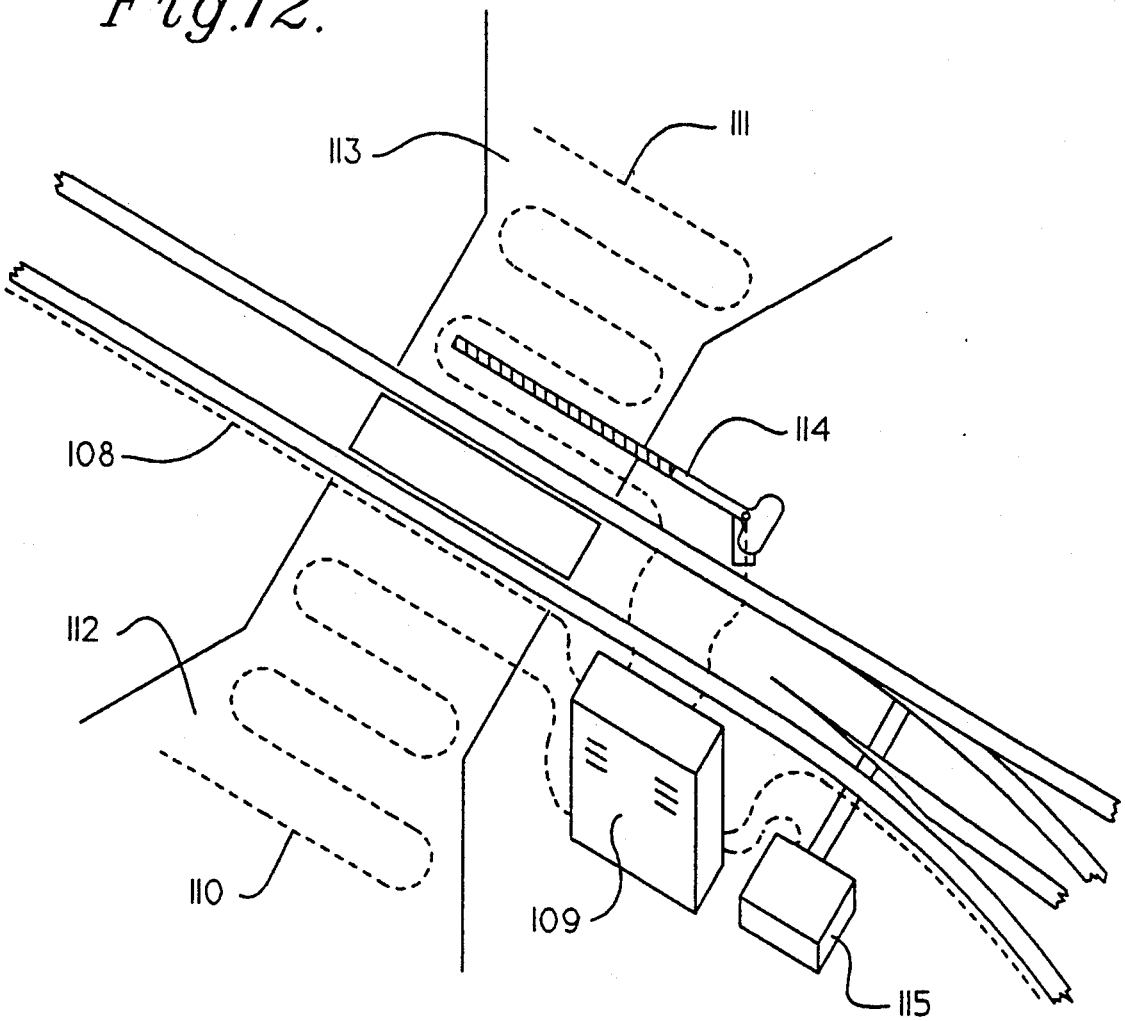
FIG. 12 is an overhead perspective view of a highway crossing and rail turnout illustrating supplemental sensors utilized to provide additional control information.

FIG. 12 illustrates the use of fiber optic sensing to monitor other typical wayside equipment and rail bed installation requirements. Traditionally, highway crossing control has been considered challenging, since it often involves such functions as: detection of approaching railway vehicles, assured warning to crossing vehicles and pedestrians, interlocking functions to avert a problematic situation, and event recording for remediation. Fiber optic sensing and communication is able to provide all of these functions, and in some cases more economically and with better results than conventional means.

Here, an elongated optical fiber conductor 108 utilized as a widely distributed sensor or a communication backbone extends along the track route. A wayside equipment case 109 houses electro-optic and control equipment such as that contained in equipment set 12 (FIG. 4). Sensitized optical fiber sections 110 and 111 are embedded within respective highway crossing road beds 112 and 113 to detect the presence of vehicles or pedestrians, utilizing the various sensing techniques discussed above. Additionally, the position of crossing gate 114 or switching device 115 may also be detected using reflection/transmission sensors.

A track circuit system has been provided utilizing fiber optic sensing to detect the presence of a railway vehicle within a track section to a greater degree of accuracy than was previously attainable. Presently preferred embodiments also provide integrated communication at higher communication rates than prior art coded track circuits. Additional supplemental sensors are provided to embellish the basic track circuit function.

Certain presently preferred embodiments of the invention and certain presently preferred methods of practicing the same have been shown and described. Upon reading the above disclosure and viewing the drawings, one skilled in the art will recognize that the "track section" may comprise a guideway structure such as a concrete channel in addition to traditional rails. Stress from such a structure can be used in a similar manner to detect vehicle position or other conditions and parameters that relate to the control and operation of the vehicle. Therefore, it is to be distinctly understood that such modifications and variations are included within the scope of the following claims.

I claim:

1. Railway track circuit apparatus for detecting a railway vehicle present in a track section having a first end and a second end, said apparatus comprising:

light emission means for generating a reference light signal at said first end of said track section;

optical sensor means for emitting a vehicle detection light signal based upon said reference light signal in response to a presence of said railway vehicle in said track section;

detector means in optical communication with said sensor means for receiving said detector light signal;

processor means operatively connected to said detector means for interpreting said vehicle detection light signal to detect presence of said railway vehicle in said track section;

said optical sensor means comprises an elongated optical fiber conductor extending along said track section from said first end to said second end; and said elongated optical fiber conductor is placed at said track section by attachment at a plurality of spaced apart locations intermediate said first end and said second end, and said elongated optical fiber conductor is used both for detection of said railway vehicle and as a communication medium.

2. The railway track circuit apparatus of claim 1 wherein said elongated optical fiber conductor is attached at a plurality of spaced apart discrete locations by placement between a rail and a plurality of rail-retaining tie plates.

3. The railway track circuit apparatus of claim 1 wherein said elongated optical fiber conductor is attached at a plurality of spaced apart discrete locations by placement under a plurality of rail crossties.

4. The railway track circuit apparatus of claim 1 further comprising at least one supplemental sensor displaced along said track section providing supplemental sensor light signals containing signal information regarding at least one additional condition within said track section.

5. The railway track circuit apparatus of claim 4 wherein said supplemental sensor is a highway crossing vehicle presence sensor.

6. The railway track circuit apparatus of claim 4 wherein said supplemental sensor is a highway crossing gate position sensor.

7. The railway track circuit apparatus of claim 4 wherein said supplemental sensor is a rail turnout switch position sensor.

8. The railway track circuit apparatus of claim 1 wherein:

said optical sensor means is placed at said track section such that force of the railway vehicle alters light propagation characteristics thereof; and said optical sensor means allow optical conduction of at least a portion of said reference light signal such that said vehicle detection light signal results.

9. The railway track circuit apparatus of claim 8 wherein said optical sensor means are placed at said track section such that force of said railway vehicle present in said track section causes preselected physical deformation to alter said light propagation characteristics.

10. The railway track circuit apparatus of claim 9 wherein:

said elongated optical fiber conductor includes few-mode optical fiber; and said processor means includes optical mode separation means for separating modes of said detector light signal and thereafter determining a general location of said railway vehicle based on a comparison of respective light intensity in each of said modes.

11. The railway track circuit apparatus of claim 9 further comprising:

transmitter means in optical communication with said elongated optical fiber conductor at said first end of said track section for impressing thereon light communication signals; and receiver means in operable communication with said elongated optical fiber conductor at said second end of said track section for receiving said light communication signals, whereby said elongated optical fiber is used both for detection of said railway vehicle and as a communication medium.

12. The railway track circuit apparatus of claim 9 wherein said elongated optical fiber conductor is placed at said track section by disposition within a longitudinal groove defined in a rail.

13. The railway track circuit apparatus of claim 9 wherein:

said elongated optical fiber conductor is attached to said track section such that said preselected physical deformation will occur by bending about a small radius when said railway vehicle is present; and, said processor means is operable to detect a general location of said railway vehicle utilizing microbending principles.

14. The railway track circuit apparatus of claim 13 wherein said processing means includes an optical time domain reflectometer operable to determine a general location of said railway vehicle.

15. The railway track circuit apparatus of claim 9 wherein said sensor means comprises at least one localized sensor attached to said track section.

16. The railway track circuit of claim 15 wherein said at least one localized sensor each comprise a sensor having a section of optical fiber attached to said track section by placement between a rail and a rail-retaining tie plate.

17. The railway track circuit of claim 15 wherein said at least one localized sensor each comprise a sensor having a section of optical fiber attached to said track section by placement between a rail and a rail crosstie.

18. The railway track circuit of claim 15 wherein said at least one localized sensor each comprise a sensor having a section of optical fiber attached to said track section by placement under a rail crosstie.

19. The railway track circuit of claim 15 wherein said at least one localized sensor each comprise a strain responsive body attachable to a rail of said track section and an optical fiber section in compliant contact with said strain responsive body.

20. Railway track circuit and communication apparatus for detecting a railway vehicle present in a track section and providing a communication link between a first end of said track section and an opposite second end of said track section, said apparatus comprising:

an elongated optical fiber conductor extending along said track section;

transmitter means for impressing railway signal communication light signals onto said elongated optical fiber conductor at said first end of said track section;

receiver means for receiving said communication light signals from said elongated optical fiber conductor at said second end of said track section;

light emission means for generating a light reference signal;

optical sensor means for emitting a vehicle detection light signal based upon said reference light signal in response to a presence of said railway vehicle in said track section;

detector means in optical communication with said sensor means for receiving said detector light signal; and processor means operatively connected to said detector means for interpreting said sensor light signal to detect presence of said railway vehicle in said track section.

21. The railway track circuit and communication apparatus of claim 20 further comprising at least one supplemental sensor displaced along said track section and connected along said elongated optical fiber conductor to impress thereon supplemental sensor light signals.

22. The railway track circuit and communication apparatus of claim 20 wherein:

said optical sensor means is placed at said track section such that force of the railway vehicle alters the light propagation characteristics thereof; and said optical sensor means allow optical conduction of at least a portion of said reference light signal such that said vehicle detection light signal results.

23. The railway track circuit and communication apparatus of claim 22 wherein said elongated optical fiber conductor also functions as said optical sensor means.

24. The railway track circuit and communication apparatus of claim 23 wherein said optical sensor means are placed such that force of said railway vehicle present in said track section causes preselected physical deformation to alter said light propagation characteristics.

25. The railway track circuit and communication apparatus of claim 24 wherein:

said elongated optical fiber conductor includes few-mode fiber; and, said processor means includes optical mode separation means for separating modes of said detector light signal and determining a general location of said railway vehicle based on a comparison of respective light intensity in each of said modes.

26. The railway track circuit and communication apparatus of claim 24 wherein said elongated optical fiber conductor is attached to said track section by placement in a longitudinal groove defined in a rail of said track section.

27. The railway track circuit and communication apparatus of claim 24 wherein:

said elongated optical fiber conductor is attached to said track section such that said preselected physical deformation will occur by bending about a small radius when said railway vehicle is present; and, said processor means is operable to detect a general location of said railway vehicle utilizing microbending principles.

28. The railway track circuit and communication apparatus of claim 27 wherein said processor means includes an optical time domain reflectometer operable to detect the general location of said railway vehicle by detection of light reflected due to bending of said elongated optical fiber conductor means.

29. The railway track circuit and communication apparatus of claim 24 wherein said elongated optical fiber conductor is attached to said track section at a plurality of spaced apart discrete locations.

30. The railway track circuit and communication apparatus of claim 29 wherein said elongated optical fiber conductor is attached to said track section at a plurality of cascaded abbreviated grooves in a rail.

31. The railway track circuit and communication apparatus of claim 29 wherein said elongated optical fiber conductor means is attached to said track section at a plurality of spaced apart discrete locations by placement between a rail and a plurality of rail-retaining tie plates.

32. The railway track circuit and communication apparatus of claim 29 wherein said elongated optical fiber conductor means is attached to said track section at a plurality of spaced apart discrete locations by placement under a plurality of rail crossties.

33. A method of detecting presence of a railway vehicle present in a track section comprising the steps of:

(a) attaching at least one optical sensor to said track section such that force of said railway vehicle in said track section alters light propagation characteristics thereof;

(b) impressing a reference light signal onto said at least one optical sensor;

(c) detecting a sensor light signal emitted from said at least one optical sensor;

(d) interpreting said sensor light signal to detect presence of said railway vehicle;

(e) extending an elongated optical fiber conductor along said track section as said at least one optical sensor;

(f) impressing light communication signals containing coded information onto said elongated optical fiber at a first end of said track section;

(g) detecting said light communication signals at a second end of said track section; and (h) decoding said light communication signals detected at said second end of said track section to obtain said coded information.

34. The method of claim 33 wherein said propagated light signal is interpreted in step (d) according to microbending techniques.

35. The method of claim 33 wherein said propagated light signal is interpreted in step (d) according to Fabry-Perot interferometric techniques.

36. The method of claim 33 wherein said at least one optical sensor includes a few-mode optical fiber conductor and wherein said propagated light signal is interpreted in step (d) by separating modes of said propagated light signal and comparing respective intensity in each of said modes.

37. The method of claim 33 wherein said propagated light signal is interpreted in step (d) to determine the general location of said railway vehicle in said track section.

38. The method of claim 33 further comprising the step of:

(i) further interpreting said sensor light signal to determine at least one additional condition within said track section.

39. The method of claim 38 wherein said at least one additional condition includes detection of a fire along said track section.

40. The method of claim 38 wherein said at least one additional condition includes a weight of said railway vehicle.

41. The method of claim 38 wherein said at least one additional condition includes a count of a number of axles on said railway vehicle.

42. The method of claim 38 wherein said at least one additional condition includes a direction of travel of said railway vehicle within said track section.

43. The method of claim 38 wherein said at least one additional condition includes a location of vibration in said track section above a threshold level.

44. Railway track circuit apparatus for detecting a railway vehicle present in a track section, said apparatus comprising:

light emission source means for generating a reference light signal;

optical sensor means for emitting a vehicle detection light signal based upon said reference light signal in response to a presence of said railway vehicle in said track section;

detector means in optical communication with said sensor means for receiving said detector light signal;

processor means operatively connected to said detector means for interpreting said vehicle detection light signal to detect presence of said railway vehicle in said track section;

wherein said optical sensor means is placed at said track section such that force of the railway vehicle alters light propagation characteristics thereof;

said optical sensor means allow optical conduction of at least a portion of said reference light signal such that said vehicle detection light signal results;

wherein said optical sensor means is placed at said track section such that force of the railway vehicle present in said track section causes preselected physical deformation to alter said light propagation characteristics;

wherein said optical sensor means comprises an elongated optical fiber conductor extending along said track section;

wherein said elongated optical fiber conductor is attached to said track section such that said preselected physical deformation will occur by bending about a small radius when said railway vehicle is present;

said processor means is operable to detect a general location of said railway vehicle utilizing microbending principles; and wherein said processing means includes an optical time domain reflectometer operable to determine a general location of said railway vehicle.

45. Railway track circuit apparatus for detecting a railway vehicle present in a track section, said apparatus comprising:

light emission source means for generating a reference light signal;

optical sensor means for emitting a vehicle detection light signal based upon said reference light signal in response to a presence of said railway vehicle in said track section;

detector means in optical communication with said sensor means for receiving said detector light signal;

processor means operatively connected to said detector means for interpreting said vehicle detection light signal to detect presence of said railway vehicle in said track section;

wherein said optical sensor means is placed at said track section such that force of the railway vehicle alters light propagation characteristics thereof;

said optical sensor means allow optical conduction of at least a portion of said reference light signal such that said vehicle detection light signal results;

wherein said optical sensor means are placed at said track section such that force of the railway vehicle present in said track section causes preselected physical deformation to alter said light propagation characteristics;

wherein said optical sensor means comprises an elongated optical fiber conductor extending along said track section;

wherein said elongated optical fiber conductor includes few-mode optical fiber; and said processor means includes optical mode separation means for separating modes of said detector light signal and thereafter determining a general location of said railway vehicle based on a comparison of respective light intensity in each of said modes.

46. Railway track circuit apparatus for detecting a railway vehicle present in a track section, said apparatus comprising:

light emission source means for generating a reference light signal;

optical sensor means for emitting a vehicle detection light signal based upon said reference light signal in response to a presence of said railway vehicle in said track section;

detector means in optical communication with said sensor means for receiving said detector light signal;

processor means operatively connected to said detector means for interpreting said vehicle detection light signal to detect presence of said railway vehicle in said track section;

wherein said optical sensor means is placed at said track section such that force of the railway vehicle alters light propagation characteristics thereof;

said optical sensor means allow optical conduction of at least a portion of said reference light signal such that said vehicle detection light signal results;

wherein said optical sensor means are placed at said track section such that force of the railway vehicle present in said track section causes preselected physical deformation to alter said light propagation characteristics;

wherein said optical sensor means comprises an elongated optical fiber conductor extending along said track section;

at least one supplemental sensor displaced along said track section providing supplemental sensor light signals containing signal information regarding at least one additional condition within said track section; and wherein said supplemental sensor is a highway crossing vehicle presence sensor.

47. Railway track circuit apparatus for detecting a railway vehicle present in a track section, said apparatus comprising:

light emission source means for generating a reference light signal;

optical sensor means for emitting a vehicle detection light signal based upon said reference light signal in response to a presence of said railway vehicle in said track section;

detector means in optical communication with said sensor means for receiving said detector light signal;

processor means operatively connected to said detector means for interpreting said vehicle detection light signal to detect presence of said railway vehicle in said track section;

wherein said optical sensor means is placed at said track section such that force of the railway vehicle alters light propagation characteristics thereof;

said optical sensor means allow optical conduction of at least a portion of said reference light signal such that said vehicle detection light signal results;

wherein said optical sensor means are placed at said track section such that force of the railway vehicle present in said track section causes preselected physical deformation to alter said light propagation characteristics;

wherein said optical sensor means comprises an elongated optical fiber conductor extending along said track section;

at least one supplemental sensor displaced along said track section providing supplemental sensor light signals containing signal information regarding at least one additional condition within said track section; and wherein said supplemental sensor is a highway crossing vehicle presence sensor.

48. Railway track circuit apparatus for detecting a railway vehicle present in a track section, said apparatus comprising:

light emission source means for generating a reference light signal;

optical sensor means for emitting a vehicle detection light signal based upon said reference light signal in response to a presence of said railway vehicle in said track section;

detector means in optical communication with said sensor means for receiving said detector light signal;

processor means operatively connected to said detector means for interpreting said vehicle detection light signal to detect presence of said railway vehicle in said track section;

wherein said optical sensor means is placed at said track section such that force of the railway vehicle alters light propagation characteristics thereof;

said optical sensor means allow optical conduction of at least a portion of said reference light signal such that said vehicle detection light signal results;

wherein said optical sensor means are placed at said track section such that force of the railway vehicle present in said track section causes preselected physical deformation to alter said light propagation characteristics;

wherein said optical sensor means comprises an elongated optical fiber conductor extending along said track section;

at least one supplemental sensor displaced along said track section providing supplemental sensor light signals containing signal information regarding at least one additional condition within said track section; and wherein said supplemental sensor is a rail turnout switch position sensor.

49. Railway track circuit and communication apparatus for detecting a railway vehicle present in a track section and providing a communication link between a first end of said track section and an opposite second end of said track section, said apparatus comprising:

an elongated optical fiber conductor extending along said track section;

transmitter means for impressing railway signal communication light signals onto said elongated optical fiber conductor at said first end of said track section;

receiver means for receiving said communication light signals from said elongated optical fiber conductor at said second end of said track section;

light emission means for generating a light reference signal;

optical sensor means for emitting a vehicle detection light signal based upon said reference light signal in response to a presence of said railway vehicle in said track section;

detector means in optical communication with said sensor means for receiving said detector light signal;

processor means operatively connected to said detector means for interpreting said sensor light signal to detect presence of said railway vehicle in said track section;

said optical sensor means is placed at said track section such that force of the railway vehicle alters the light propagation characteristics thereof;

said optical sensor means allow optical conduction of at least a portion of said reference light signal such that said vehicle detection light signal results;

said elongated optical fiber conductor also functions as said optical sensor means;

said optical sensor means are placed such that force of said railway vehicle present in said track section causes preselected physical deformation to alter said light propagation characteristics;

said elongated optical fiber conductor is attached to said track section such that said preselected physical deformation will occur by bending about a small radius when said railway vehicle is present; and, said processor means is operable to detect a general location of said railway vehicle utilizing microbending principles.

50. Railway track circuit and communication apparatus for detecting a railway vehicle present in a track section an d providing a communication link between a first end of said track section and an opposite second end of said track section, said apparatus comprising:

an elongated optical fiber conductor extending along said track section;

transmitter means for impressing railway signal communication light signals onto said elongated optical fiber conductor at said first end of said track section;

receiver means for receiving said communication light signals from said elongated optical fiber conductor at said second end of said track section;

light emission means for generating a light reference signal;

optical sensor means for emitting a vehicle detection light signal based upon said reference light signal in response to a presence of said railway vehicle in said track section;

detector means in optical communication with said sensor means for receiving said detector light signal;

processor means operatively connected to said detector means for interpreting said sensor light signal to detect presence of said railway vehicle in said track section;

said optical sensor means is placed at said track section such that force of the railway vehicle alters the light propagation characteristics thereof;

said optical sensor means allow optical conduction of at least a portion of said reference light signal such that said vehicle detection light signal results;

said elongated optical fiber conductor also functions as said optical sensor means;

said optical sensor means are placed such that force of said railway vehicle present in said track section causes preselected physical deformation to alter said light propagation characteristics;

said elongated optical fiber conductor includes few-mode fiber; and, said processor means includes optical mode separation means for separating modes of said detector light signal and determining a general location of said railway vehicle based on a comparison of respective light intensity in each of said modes.

51. A method of detecting presence of a railway vehicle present in a track section comprising the steps of:

(a) attaching at least one optical sensor to said track section such that force of said railway vehicle in said track section alters light propagation characteristics thereof;

(b) impressing a reference light signal onto said at least one optical sensor;

(c) detecting a sensor light signal emitted from said at least one optical sensor; and (d) interpreting said sensor light signal to detect presence of said railway vehicle according to Fabry-Perot interferometric techniques.

52. A method of detecting presence of a railway vehicle present in a track section comprising the steps of:

(a) attaching at least one optical sensor including a few-mode optical fiber conductor to said track section such that force of said railway vehicle in said track section alters light propagation characteristics thereof;

(b) impressing a reference light signal onto said at least one optical sensor;

(c) detecting a sensor light signal emitted from said at least one optical sensor;

(d) interpreting said sensor light signal to detect presence of said railway vehicle by separating modes of said propagated light signal and comparing respective intensity in each of said modes; and wherein said at least one optical sensor includes a few-mode optical fiber conductor.

* * * * *

UNITED STATES PATENT AND TRADEMARK OFFICE

CERTIFICATE OF CORRECTION

PATENT NO. : 5,330,136

DATED : July 19, 1994

INVENTOR(S) : MICHAEL E. COLBAUGH

It is certified that error appears in the above-indentified patent and that said Letters Patent is hereby corrected as shown below:

Column 8, line 24, claim 1, after "emission" insert --source--.

Column 16, line 8, claim 50, change "an d" to --and--.

Signed and Sealed this

Twentieth Day of December, 1994

*Attest:*

Bruce Lehman

BRUCE LEHMAN

*Attesting Officer*

*Commissioner of Patents and Trademarks*